US009578969B1

(12) United States Patent
Su

(10) Patent No.: US 9,578,969 B1
(45) Date of Patent: Feb. 28, 2017

(54) ADJUSTABLE FOOTREST RING FOR CHAIR

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 46 days.

(21) Appl. No.: 14/845,277

(22) Filed: Sep. 4, 2015

(51) Int. Cl.
*A47C 7/50* (2006.01)
*A47C 7/00* (2006.01)

(52) U.S. Cl.
CPC ..... *A47C 7/506* (2013.01); *A47C 7/004* (2013.01)

(58) Field of Classification Search
CPC .. A47C 7/50; A47C 7/52; A47C 7/506; A47C 7/004
USPC ... 297/423.25, 423.38, 423.24, 423.4, 423.1, 297/451.5, 463.1, 463.2
See application file for complete search history.

(56) References Cited

U.S. PATENT DOCUMENTS 3,458,234 A * 7/1969 Bates ..... A47C 7/50 248/125.1
3,820,844 A * 6/1974 Fortnam ..... A47C 7/52 297/240
4,948,149 A * 8/1990 Lin ..... A63B 61/02 403/104
5,470,038 A * 11/1995 Clark ..... A45B 5/00 248/156
5,988,754 A * 11/1999 Lamart ..... A47C 7/506 248/161
6,578,804 B2 * 6/2003 Lin ..... A47C 7/004 248/188.1
7,452,034 B2 * 11/2008 Jung ..... A47C 7/004 248/188.7
8,297,563 B2 * 10/2012 Tsai ..... A47C 7/004 248/125.1
8,517,472 B1 * 8/2013 Proctor ..... A47C 7/50 297/423.1
8,931,848 B2 * 1/2015 Archambault ..... B60N 3/063 297/423.25
8,991,928 B2 * 3/2015 Hsieh ..... A47C 7/004 297/344.19
9,144,315 B1 * 9/2015 Cheng ..... A47C 7/506
9,220,346 B1 * 12/2015 Wu ..... A47C 7/506
9,254,041 B2 * 2/2016 Kessler ..... A47C 7/004
2006/0175518 A1 * 8/2006 Hu ..... A47C 7/004 248/425

(Continued)

*Primary Examiner* — Brian Glessner
*Assistant Examiner* — Adam Barlow

(57) ABSTRACT

The invention provides an adjustable footrest ring for a chair with a central post. The invention includes an inner sleeve, a quick-release handle, a support frame and a ring. The inner sleeve is used for being put around the central post and has an outer threaded surface, a through slot and a pair of passing holes below the outer threaded surface. The quick-release handle is formed with a through hole at an end thereof. The through hole corresponds to the passing holes for being passed through by a bolt. The inner sleeve is shrunken when the bolt is tightened and the quick-release handle is closed. The support frame has an outer sleeve and support rods radially extending therefrom. An inner threaded surface is formed inside the outer sleeve so as to screw the outer sleeve onto the inner sleeve. The ring is connected to outer ends of the support rods.

10 Claims, 6 Drawing Sheets

(56) References Cited

U.S. PATENT DOCUMENTS

| | | | | |
|---|---|---|---|---|
| 2007/0290541 | A1* | 12/2007 | Tsai | A47C 7/52<br>297/423.1 |
| 2010/0201177 | A1* | 8/2010 | Moore | A47C 7/52<br>297/423.25 |
| 2014/0070592 | A1* | 3/2014 | Yeh | A47C 7/004<br>297/423.38 |
| 2014/0265512 | A1* | 9/2014 | Pritchard | A47C 7/506<br>297/423.38 |

* cited by examiner

ADJUSTABLE FOOTREST RING FOR CHAIR

BACKGROUND OF THE INVENTION

1. Technical Field

The invention relates to chairs, particularly to a chair with a footrest.

2. Related Art

Office chairs with a cushion elevation mechanism and/or flexible back have been very popular. Many chairs are provided with a flexible back with tilt flexibility to satisfy various requirements of users. Although existing chairs are very comfortable for users, almost all office chairs do not provide a footrest for supporting a user's feet to relax a user's his or her legs.

Even if some office chairs provide a footrest, but the position of the footrest cannot be adjusted or is hard to be adjusted. Users with different height need different positions of the footrest. A user will feel uncomfortable if the footrest cannot be set a proper position.

SUMMARY OF THE INVENTION

An object of the invention is to provide an adjustable footrest ring for a chair with a central post, which allows position of the footrest on the central post to be easily adjusted to satisfy various users' requirements.

To accomplish the above object, the adjustable footrest ring of the invention includes an inner sleeve, a quick-release handle, a support frame and a ring. The inner sleeve is used for being put around the central post and has an outer threaded surface, a through slot and a pair of passing holes below the outer threaded surface. The quick-release handle is formed with a through hole at an end thereof. The through hole corresponds to the passing holes for being passed through by a bolt. The inner sleeve is shrunken when the bolt is tightened and the quick-release handle is closed. The support frame has an outer sleeve and support rods radially extending therefrom. An inner threaded surface is formed inside the outer sleeve so as to screw the outer sleeve onto the inner sleeve. The ring is connected to outer ends of the support rods.

DETAILED DESCRIPTION OF THE INVENTION

Figure 1:
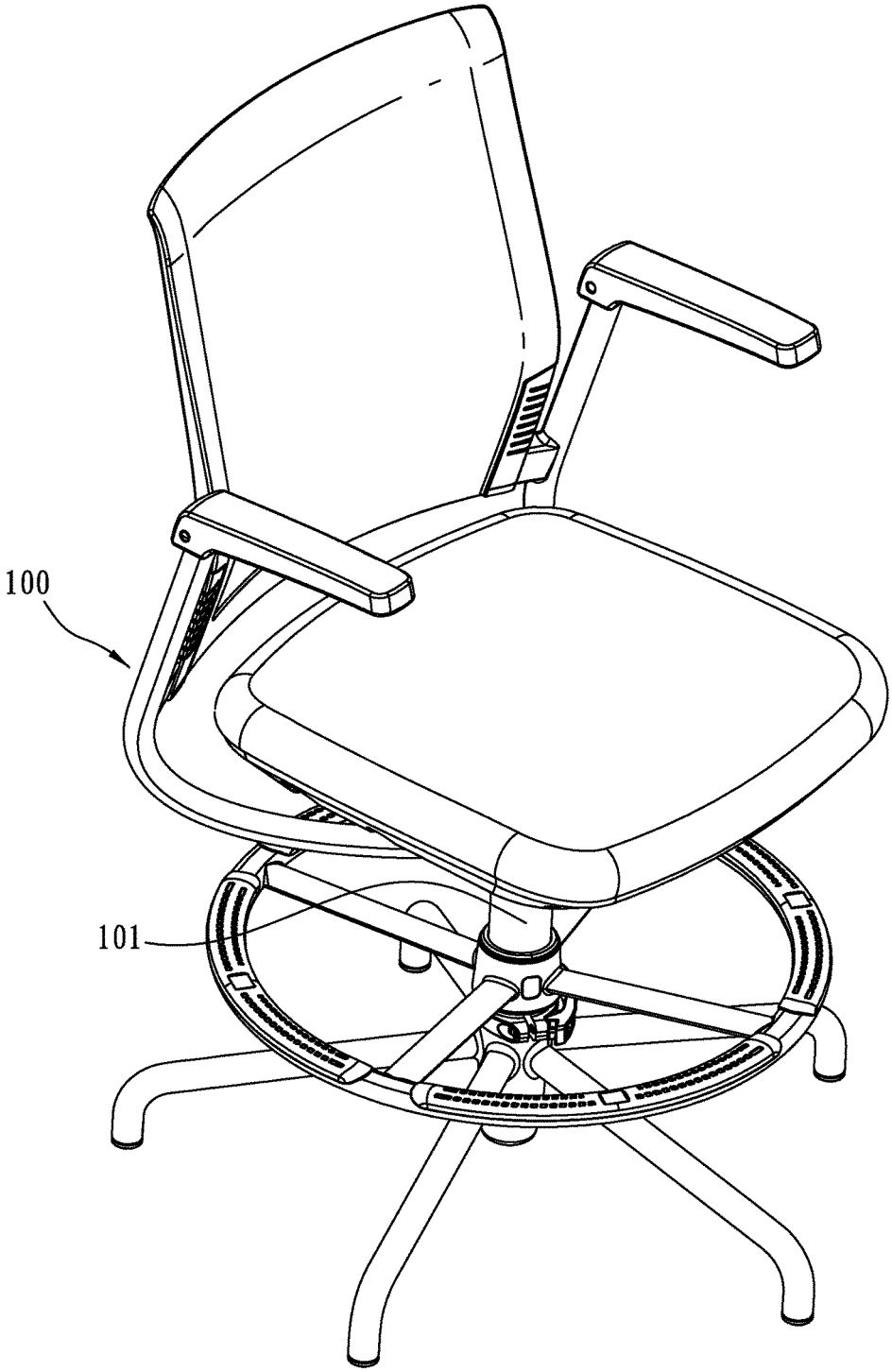
FIG. 1 is a schematic view of the invention assembled with a chair.
Figure 2:
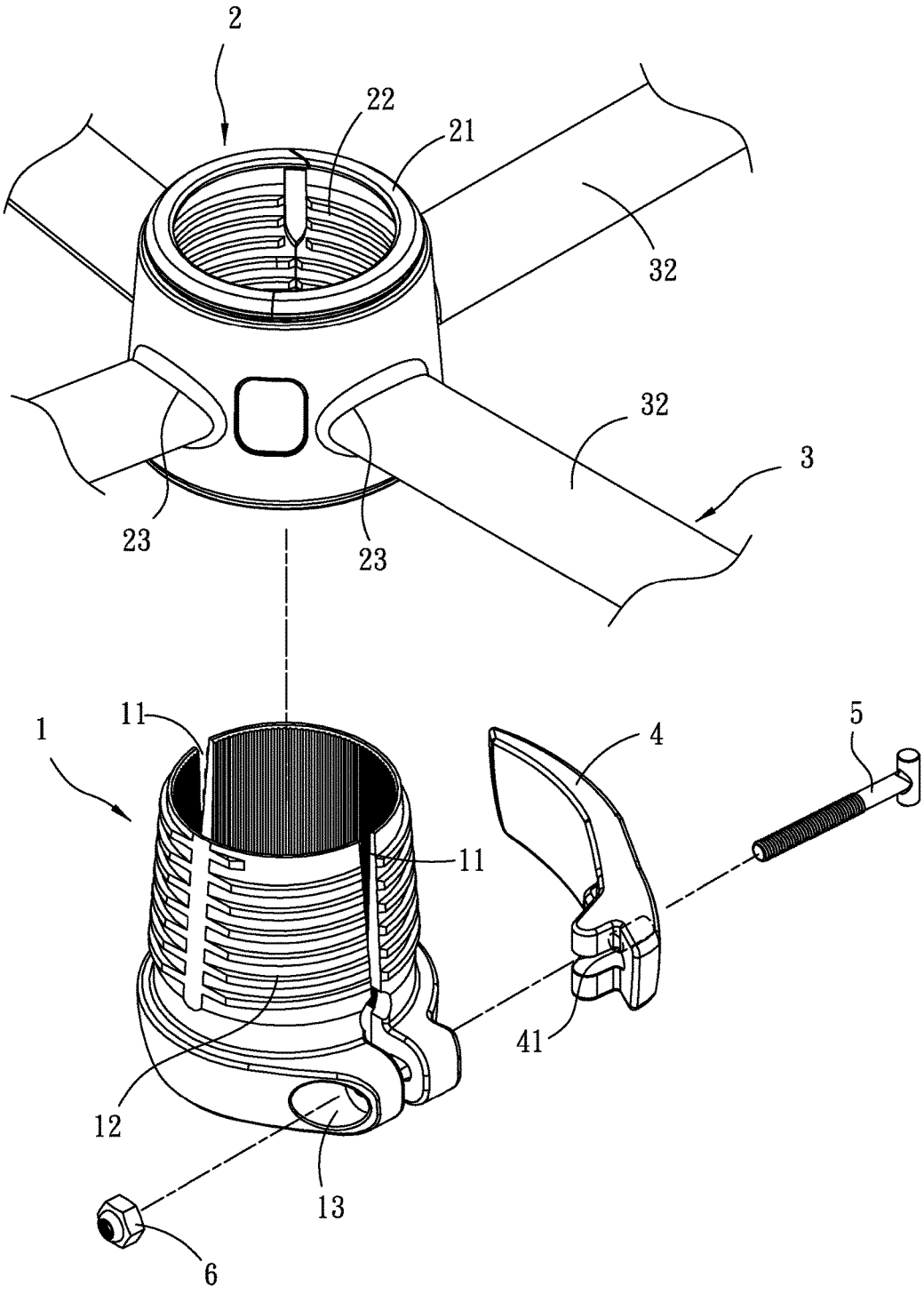
FIG. 2 is an exploded view of the invention.

Please refer to FIGS. 1 and 2. As shown, the footrest ring of the invention is installed onto a central post 101 of a chair 100.

As shown in FIG. 2, the invention includes an inner sleeve 1, a quick-release handle 4, a support frame 2 and a ring 3. The inner sleeve 1 is used for being put around the central post 101. An outer threaded surface 12 is formed on the inner sleeve 1. The inner sleeve 1 has a through slot 11 so as to make the inner sleeve 1 have a C-shape cross-section. A pair of passing holes 13 is provided below the outer threaded surface 12 and beside the through slot 11. The inner sleeve 1 can be normally keep its original shape or forcedly shrunken because of the through slot 11. Preferably, as shown in the FIG. 2, the outer threaded surface 12 can be a frustum of a hollow cone whose bottom diameter is slightly greater than its top diameter.

The quick-release handle 4 is formed with a through hole 41 at an end thereof. The through hole 41 corresponds to the passing holes 13 for being passed through by a bolt 5. The bolt 5 passes through the through hole 41 and the passing holes 13 to screw with an anti-release nut 6. In the shown embodiment, the bolt 5 is of a T-shape for being rotated by a hand. The inner sleeve 1 can be shrunken to clamp the central post 101 when the bolt 5 with the nut 6 is tightened and the quick-release handle 4 is closed.

Referring to FIG. 2 again, the support frame 2 includes an outer sleeve 21 and a plurality of support rods 32 radially extending therefrom. Each support rods 32 has an identical length. An inner threaded surface 22 is formed inside the outer sleeve 21 so as to be able to screw the outer sleeve 21 onto the inner sleeve 1. In the shown embodiment, the support rods 32 are fastened to the outer sleeve 21 by separately inserting the support rods 21 into first fixing holes 23 in the outer sleeve 21. Of course, other fastening manners are also available, for example, welding or screwing. In correspondence to the shape of the outer threaded surface 12, the inner threaded surface 22 is conical in shape. Because of the conic shapes of the threaded surfaces 12, 22, the outer sleeve 21 can be firmly screwed onto the inner sleeve.

Figure 3:
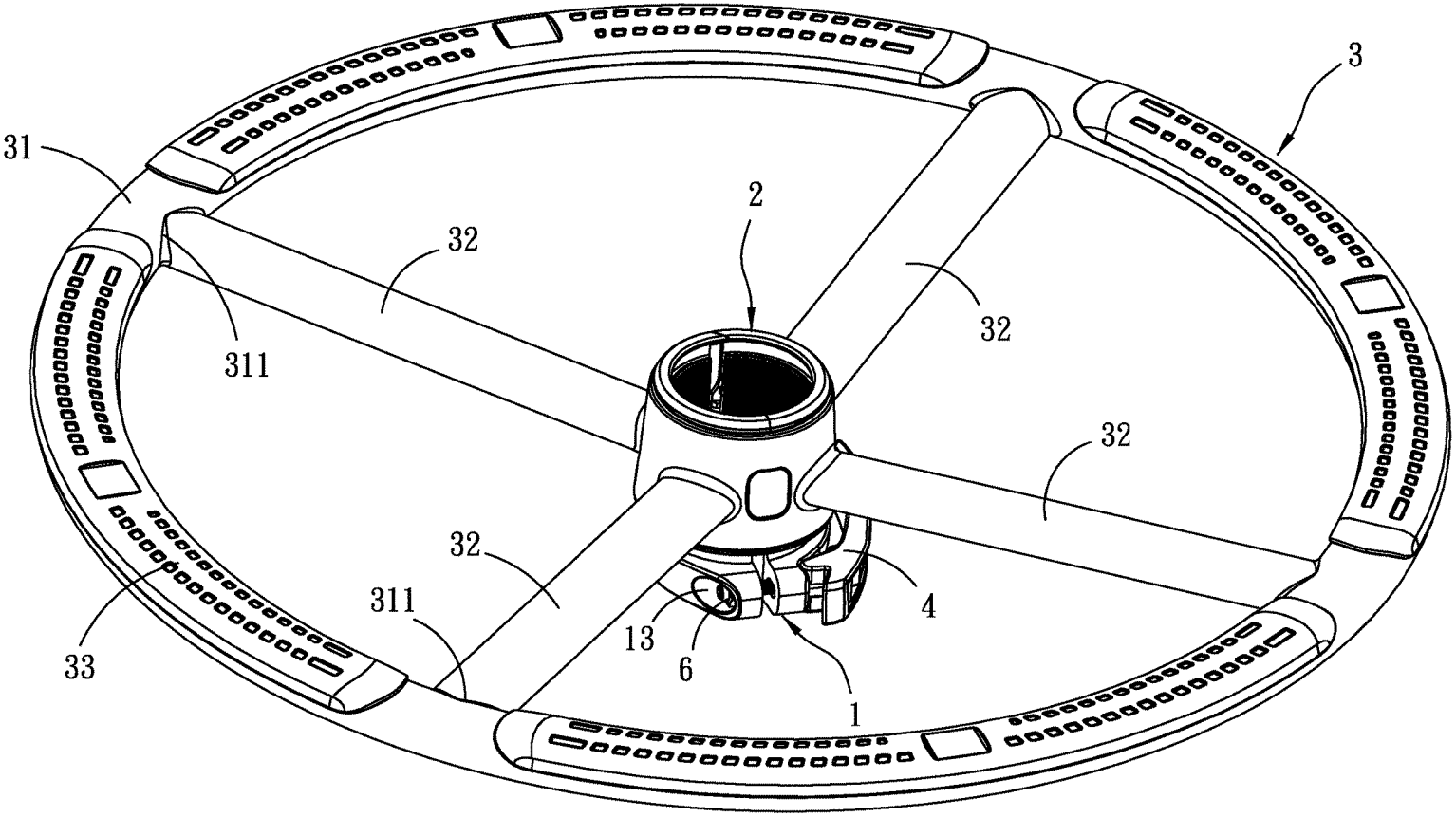
FIG. 3 is an assembled view of the invention.

Please refer to FIG. 3. The ring 3 includes a ring body 31 which connects to outer ends of the support rods 32 and anti-slip pads 33 on the ring body 31. The ring body 31 is provided with second fixing holes 311 for being inserted by the support rods 21. Alternatively, as abovementioned, the junction between the support rods 21 and the ring body 31 may be welding, screwing or any other fastening manners. As a result, the ring 3 is assembled with the outer sleeve 21 so as to rotate conjunctively.

Figure 4:
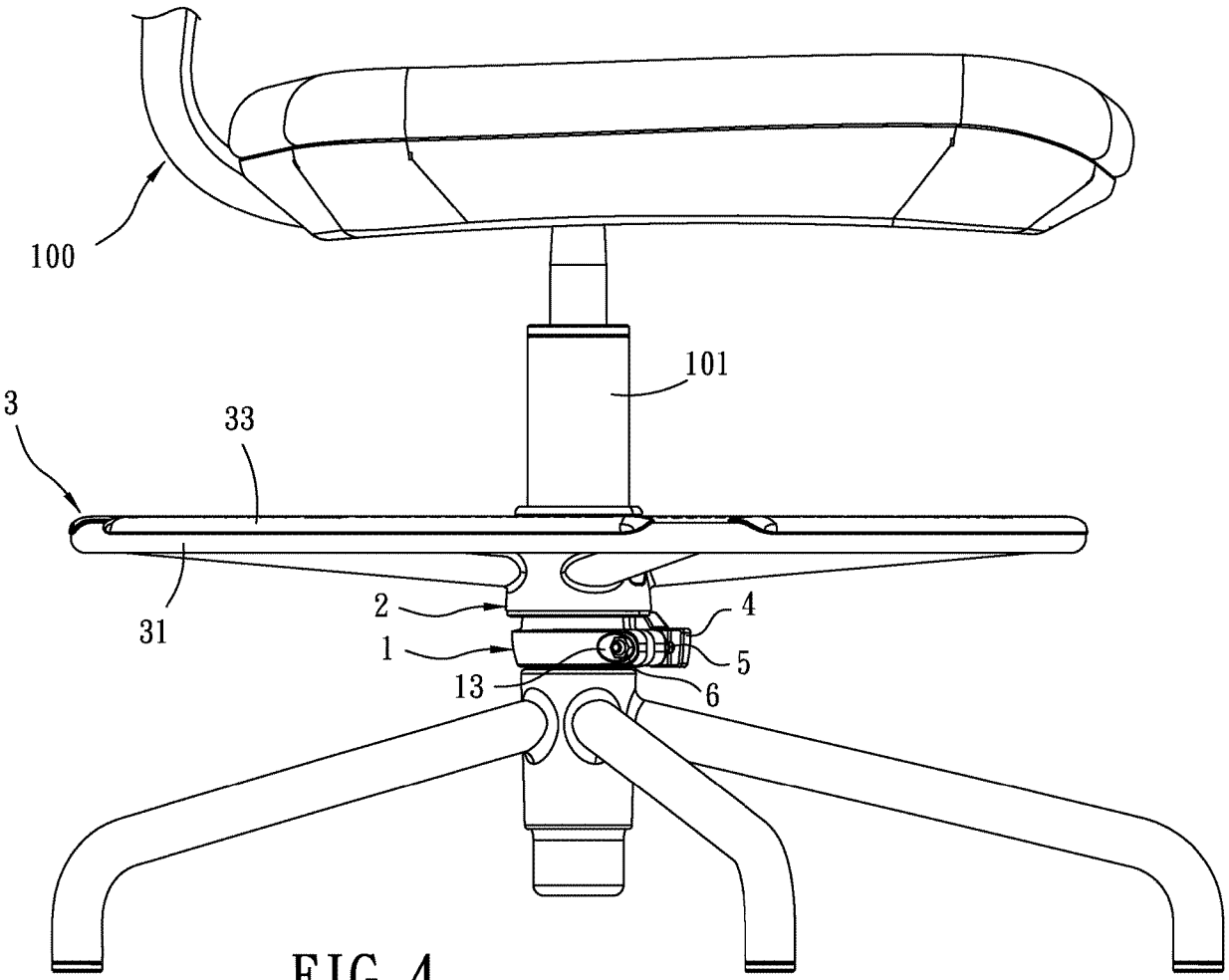
FIGS. 4-6 are side views showing the movement of the invention in operation.
Figure 5:
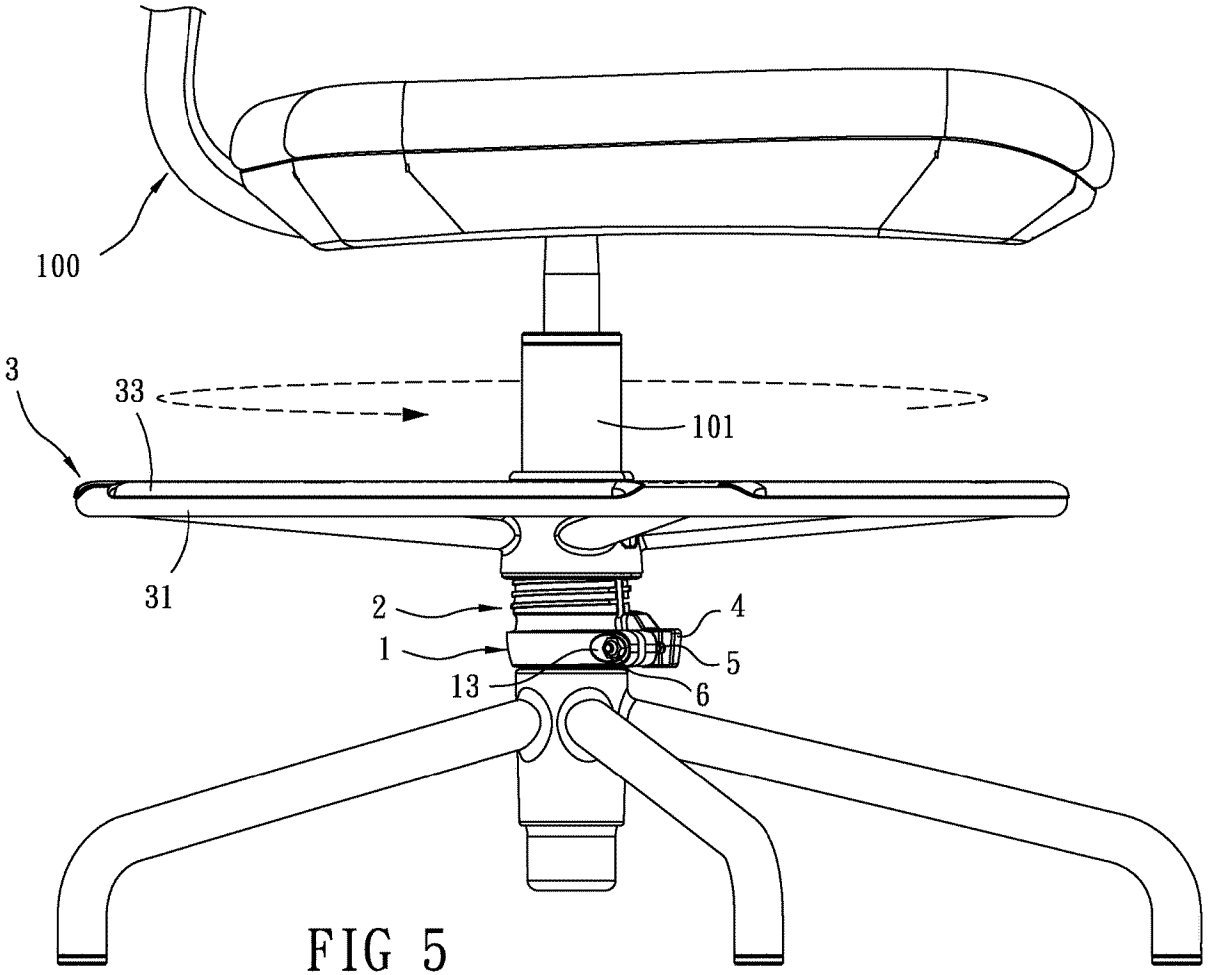
Figure 6:
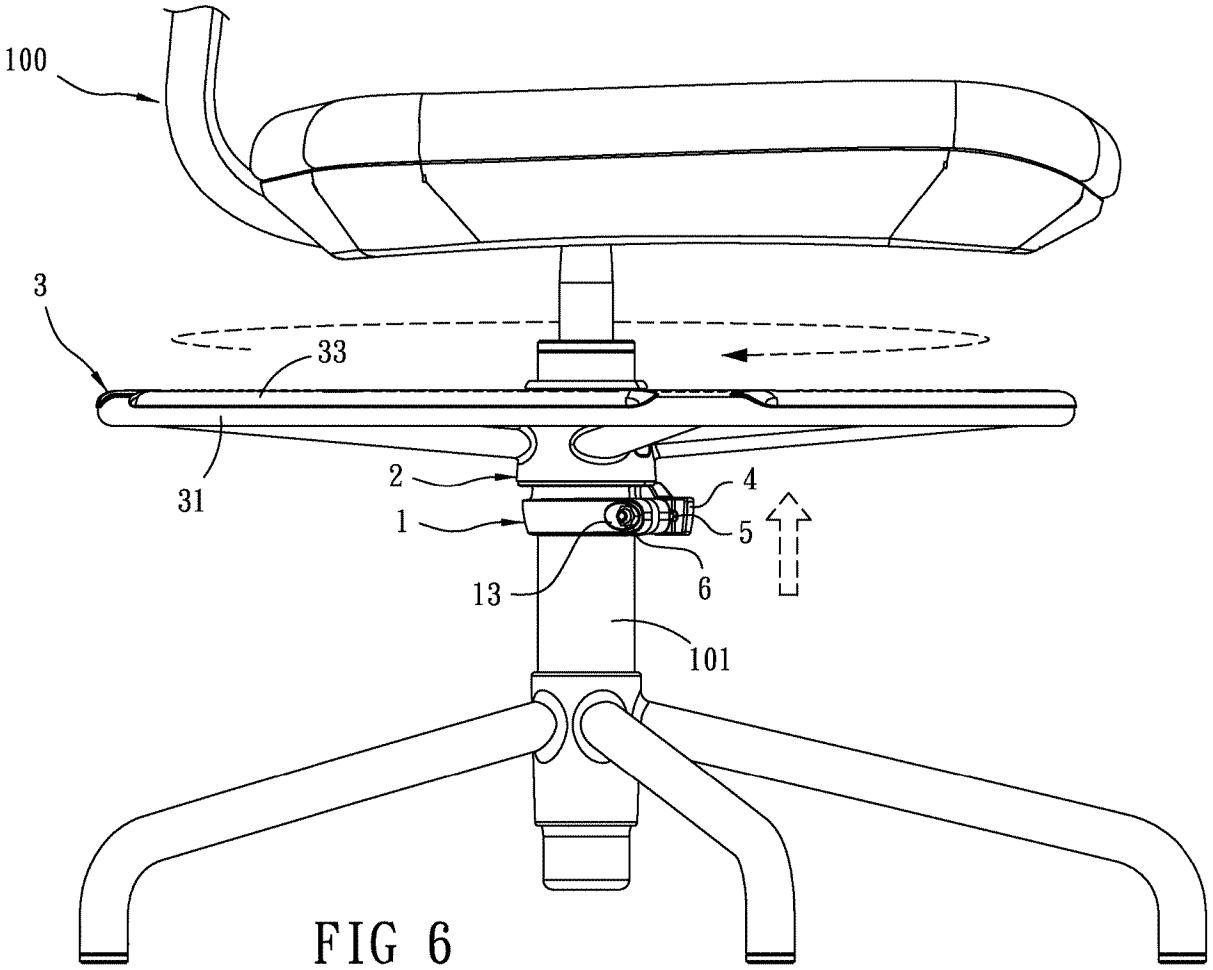

Please refer to FIG. 4. The footrest ring of the invention is fastened around a central post 101 of a chair 100 by pressing down the quick-handle so that the inner sleeve 1 cannot be moved any longer. The support frame 2 is fastened onto the inner sleeve 1 by screwing the inner and outer threaded surfaces 12, 13. When a user wants to adjust the position of the footrest ring, as shown in FIG. 5, loosen the outer sleeve 21 with respect to the inner sleeve 1 and open the quick-release handle 4, such that the inner sleeve 1 can be slid along the central post 101. As shown in FIG. 6, when the footrest ring has been moved to a desired position, close the quick-release handle 4 and screw up the outer sleeve 21 with the inner sleeve 1 to re-position the footrest ring.

It will be appreciated by persons skilled in the art that the above embodiment has been described by way of example only and not in any limitative sense, and that various alterations and modifications are possible without departure from the scope of the invention as defined by the appended claims.

What is claimed is:

1. An adjustable footrest ring for a chair with a central post, comprising:

an inner sleeve, used for being put around the central post, an outer threaded surface being formed on the inner sleeve, having a through slot, a pair of passing holes being provided below the outer threaded surface;

a quick-release handle, being formed with a through hole at an end thereof, the through hole corresponding to the passing holes for being passed through by a bolt, wherein the inner sleeve is shrunken when the bolt is tightened and the quick-release handle is closed;

a support frame, having an outer sleeve and support rods radially extending therefrom, an inner threaded surface being formed inside the outer sleeve so as to screw the outer sleeve onto the inner sleeve; and a ring, connected to outer ends of the support rods.

2. The adjustable footrest ring of claim 1, wherein the pair of passing holes is located beside the through slot.

3. The adjustable footrest ring of claim 1, wherein the outer threaded surface is a frustum of a cone in shape, and a bottom diameter is greater than a top diameter.

4. The adjustable footrest ring of claim 3, wherein the inner threaded surface is a frustum of a cone in shape, and a bottom diameter is greater than a top diameter.

5. The adjustable footrest ring of claim 1, wherein the bolt is of a T-shape.

6. The adjustable footrest ring of claim 1, wherein the bolt is screwed with a nut.

7. The adjustable footrest ring of claim 1, wherein the support rods are four in number.

8. The adjustable footrest ring of claim 1, wherein the ring comprises a ring body connected to the support rods and anti-slip pads on the ring body.

9. The adjustable footrest ring of claim 1, wherein an inner end of each of the support rods is inserted into one of first fixing holes in the outer sleeve.

10. The adjustable footrest ring of claim 1, wherein the outer end of each of the support rods is inserted into one of second fixing holes in the ring.

* * * * *